US009365029B2

(12) United States Patent
Maul et al.

(10) Patent No.: US 9,365,029 B2
(45) Date of Patent: Jun. 14, 2016

(54) VACUUM DRUM SYSTEM IN A PRINTING MATERIAL SHEET PROCESSING MACHINE AND DRYING UNIT

(71) Applicant: HEIDELBERGER DRUCKMASCHINEN AG, Heidelberg (DE)

(72) Inventors: Albert Maul, Heidelberg (DE); Michael Gieser, Oftersheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/635,095

(22) Filed: Mar. 2, 2015

(65) Prior Publication Data

US 2015/0246525 A1 Sep. 3, 2015

(30) Foreign Application Priority Data

Feb. 28, 2014 (DE) ..... 10 2014 002 907

(51) Int. Cl.

| | |
|---|---|
| ***B41F 35/00*** | (2006.01) |
| ***B41F 23/04*** | (2006.01) |
| ***B65H 5/22*** | (2006.01) |
| ***B41F 21/10*** | (2006.01) |
| *B41F 19/00* | (2006.01) |

(52) U.S. Cl.

CPC ..... *B41F 23/0406* (2013.01); *B41F 21/102* (2013.01); *B65H 5/226* (2013.01); *B41F 19/00* (2013.01)

(58) Field of Classification Search

CPC ..... B65H 5/226
USPC ..... 101/424.1
See application file for complete search history.

(56) References Cited

U.S. PATENT DOCUMENTS

| | | | | |
|---|---|---|---|---|
| 4,145,040 | A | 3/1979 | Huber | |
| 5,355,156 | A * | 10/1994 | Balzeit | H04N 1/047 271/196 |
| 5,865,433 | A * | 2/1999 | Morrissette | B41F 27/02 101/389.1 |
| 6,088,081 | A * | 7/2000 | Doi | G03B 27/60 355/27 |
| 6,092,894 | A * | 7/2000 | Nuita et al. | 347/104 |
| 6,209,867 | B1 * | 4/2001 | Madsen et al. | 271/276 |
| 7,150,456 | B2 | 12/2006 | Gerstenberger et al. | |
| 7,374,167 | B2 | 5/2008 | Behrens et al. | |
| 8,720,334 | B2 | 5/2014 | Kusaka | |
| 2003/0172942 | A1 * | 9/2003 | Schlisio | A24C 5/471 131/95 |
| 2012/0068401 | A1 | 3/2012 | Kondo et al. | |

FOREIGN PATENT DOCUMENTS

| | | | |
|---|---|---|---|
| DE | 10342482 | B3 | 5/2004 |
| DE | 10346782 | A1 | 5/2004 |
| DE | 102006019029 | A1 | 10/2007 |
| DE | 102010000996 | A1 | 7/2010 |
| JP | S5251209 | A | 4/1977 |
| JP | S5573345 | U | 5/1980 |
| JP | S5821440 | U | 2/1983 |
| JP | 2005022398 | A | 1/2005 |
| JP | 2007331223 | A | 12/2007 |

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A vacuum drum system for a printing material sheet processing machine includes suction grooves for pneumatically holding a sheet of printing material and closing slides disposed in the suction grooves. A drying unit having the vacuum drum system is also provided.

11 Claims, 7 Drawing Sheets

VACUUM DRUM SYSTEM IN A PRINTING MATERIAL SHEET PROCESSING MACHINE AND DRYING UNIT

CROSS-REFERENCE TO RELATED APPLICATION

This application claims the priority, under 35 U.S.C. §119, of German Patent Application DE 10 2014 002 907.7, filed Feb. 28, 2014; the prior application is herewith incorporated by reference in its entirety.

BACKGROUND OF THE INVENTION

Field of the Invention

The present invention relates to a vacuum drum system in a machine for processing sheets of printing material and to a drying unit.

German Patent Application DE 103 46 782 A1, corresponding to U.S. Pat. No. 7,150,456 and German Patent Application DE 10 2010 000 996 A1 describe vacuum drums with suction grooves for holding the sheets of printing material. The disclosed vacuum drums act as storage drums in reversing devices of printing presses. The vacuum in the suction grooves may be switched off by using valves. Such prior art vacuum drum systems are not well suited for being used in special-purpose units of a printing press.

SUMMARY OF THE INVENTION

It is accordingly an object of the invention to provide a vacuum drum system in a printing material sheet processing machine and a drying unit having the vacuum drum system, which overcome the hereinafore-mentioned disadvantages of the heretofore-known systems and units of this general type and which are well-suited for use with special-purpose units.

With the foregoing and other objects in view there is provided, in accordance with the invention, a vacuum drum system for a sheet printing material processing machine, comprising suction grooves for pneumatically holding the sheet of printing material and closing slides disposed in the suction grooves.

An advantage of the invention is that the closing slides reliably avoid undesired air flows. Moreover, format changes of the vacuum drum system of the invention are easily automatable. The vacuum drum system of the invention is particularly well-suited for applications in which an inert gas is used and is to be prevented from entering the vacuum drum system. In addition, the system is easy for the operator to dismount, for instance without tools, allowing the system to be easily cleaned.

In accordance with another feature of the invention, the closing slides may be displaceable into different positions, allowing the active suction length of the suction grooves to be variable to accommodate sheets of printing material of different formats.

In accordance with a further feature of the invention, the closing slides may be curved at a different radius than the suction grooves, causing the closing slides to lock in position by a self-clamping effect.

In accordance with an added feature of the invention, the vacuum drum system may include a cylinder gap and receiving grooves and in one setting the closing slides bridge the cylinder gap and fit in the receiving grooves.

In accordance with an additional feature of the invention, the vacuum drum system may include a vacuum drum and a slide adjustment device disposed next to the vacuum drum and provided for retaining the closing slides as the vacuum drum rotates while allowing the retained slides to slide along the suction grooves.

Thus, the vacuum drum system refers to a system that is formed either exclusively of the vacuum drum or of the vacuum drum and the slide adjustment device together.

In accordance with yet another feature of the invention, the slide adjustment device may include a number of actuating drives connectible to the closing slides through fit-in or plug profiles, with the actuating drives potentially embodied as operating cylinders and the fit-in or plug profiles as cross grooves in the closing slides.

In accordance with yet a further feature of the invention, the slide adjustment device may include overload protectors for protecting the actuating drives against overloading. The overload protectors may be embodied as ratchets.

In accordance with yet an added feature of the invention, the slide adjustment device may include a monitoring device for detecting error positions of the actuating drives. The monitoring device may be a photoelectric sensor or light barrier.

In accordance with again another feature of the invention, the suction grooves may be covered by a cylinder cover and by suction slits formed therein. The suction slits may have a smaller width than the suction grooves.

With the objects of the invention in view, there is concomitantly provided a drying unit for drying the sheets of printing material by UV or electron radiation in an inert gas atmosphere, comprising a vacuum drum system according to the invention.

Other features which are considered as characteristic for the invention are set forth in the appended claims.

Although the invention is illustrated and described herein as embodied in a vacuum drum system in a printing material sheet processing machine and a drying unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

FIGS. 1 to 7 are diagrammatic views in which sectional components are not indicated by hatched areas for reasons of clarity. In FIGS. 1 to 7, corresponding components bear the same reference symbols.

Figure 1:
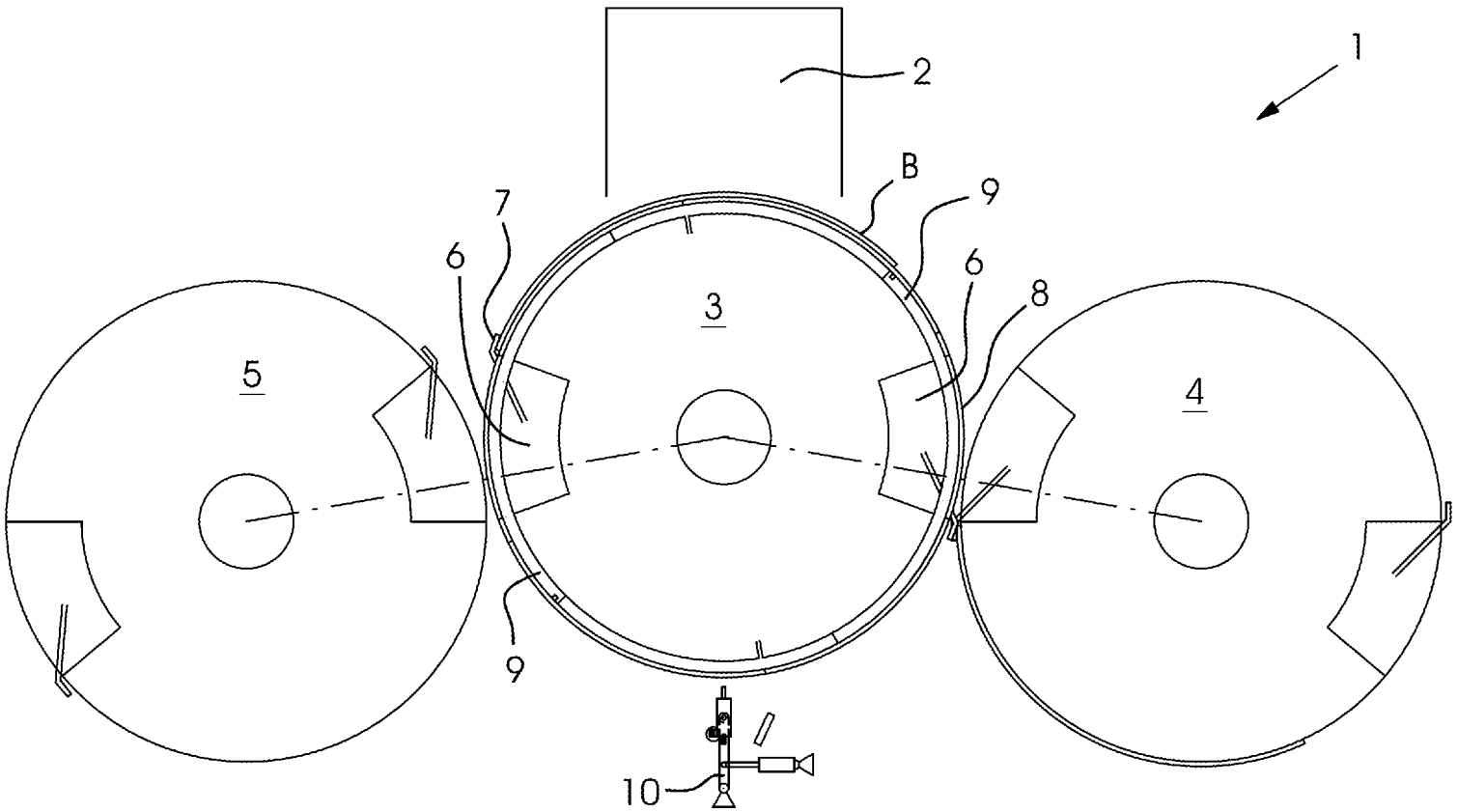
FIG. 1 is a diagrammatic, longitudinal-sectional view of a printing press with a vacuum drum and a slide adjustment device.
Figure 4:
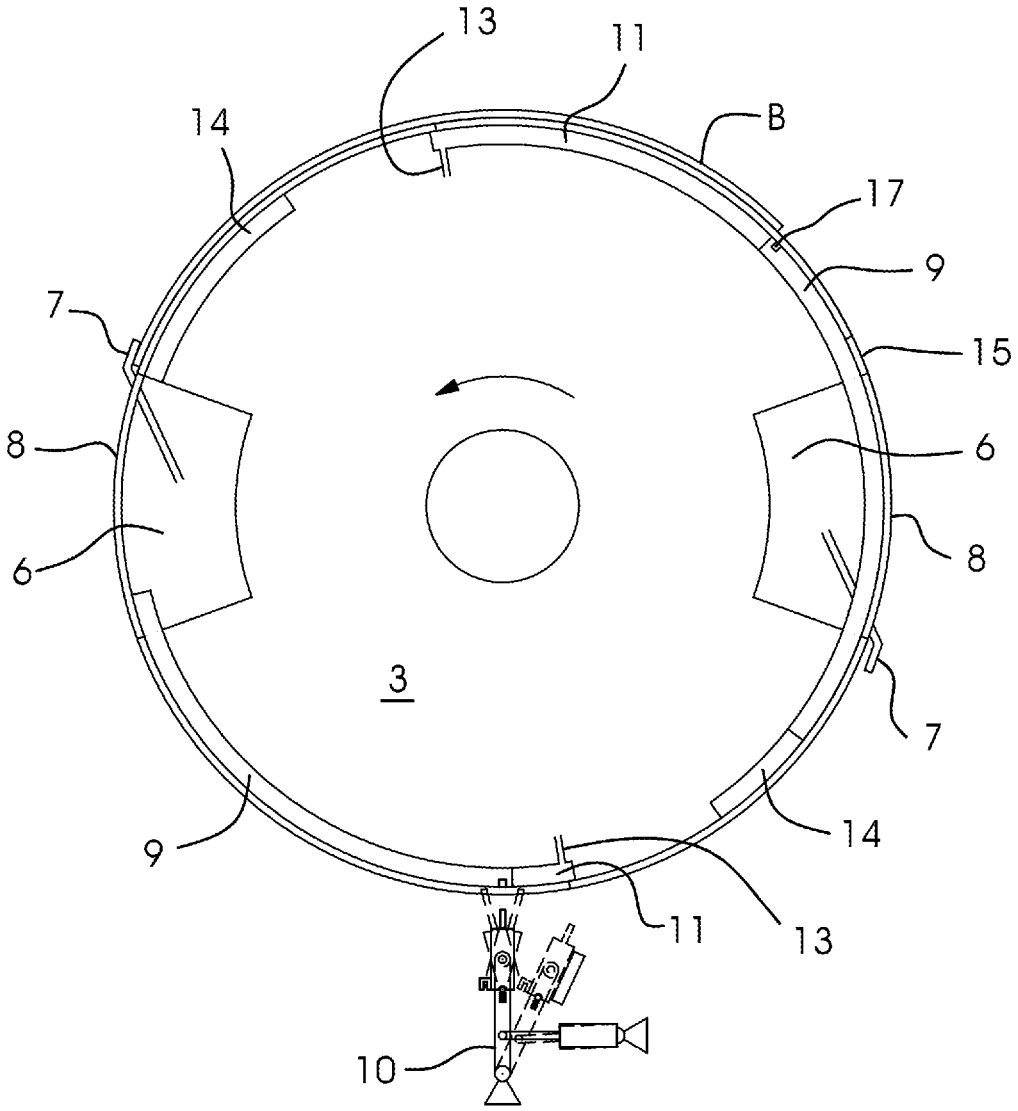
FIG. 4 is a cross-sectional view of a first variant of the vacuum drum of FIG. 1.

Referring now to the figures of the drawings in detail and first, particularly, to FIG. 1 thereof, there is seen a section of a printing press 1 for printing on sheets B in a planographic offset printing process. A special-purpose unit 2 of the printing press 1 is shown. The special-purpose unit 2 is disposed in line with non-illustrated lithographic offset printing units of the printing press 1 and includes a vacuum drum 3 for receiving sheets B from a transport cylinder 4 and transferring them to a transport cylinder 5 in accordance with a conveying cycle. The vacuum drum 3 may also be referred to as a vacuum drum system. The vacuum drum 3 has diametrically opposed cylinder gaps 6 in which respective clamping grippers 7 for gripping the leading edges of the sheets B are provided. If the special-purpose unit 2 is an inert gas drying unit for curing the ink on the sheet B by irradiation with UV light or electron beams, the cylinder gaps 6 are covered by circumferential-side covers 8 and closing slides 9 are constructed in a long version, as seen in FIG. 4. If the special-purpose unit 2 is an in-line measuring unit for optically measuring print quality parameters or an inkjet printing unit, there are no covers and the closing slides 9 are constructed in a short version, seen in FIG. 5.

Figure 2:
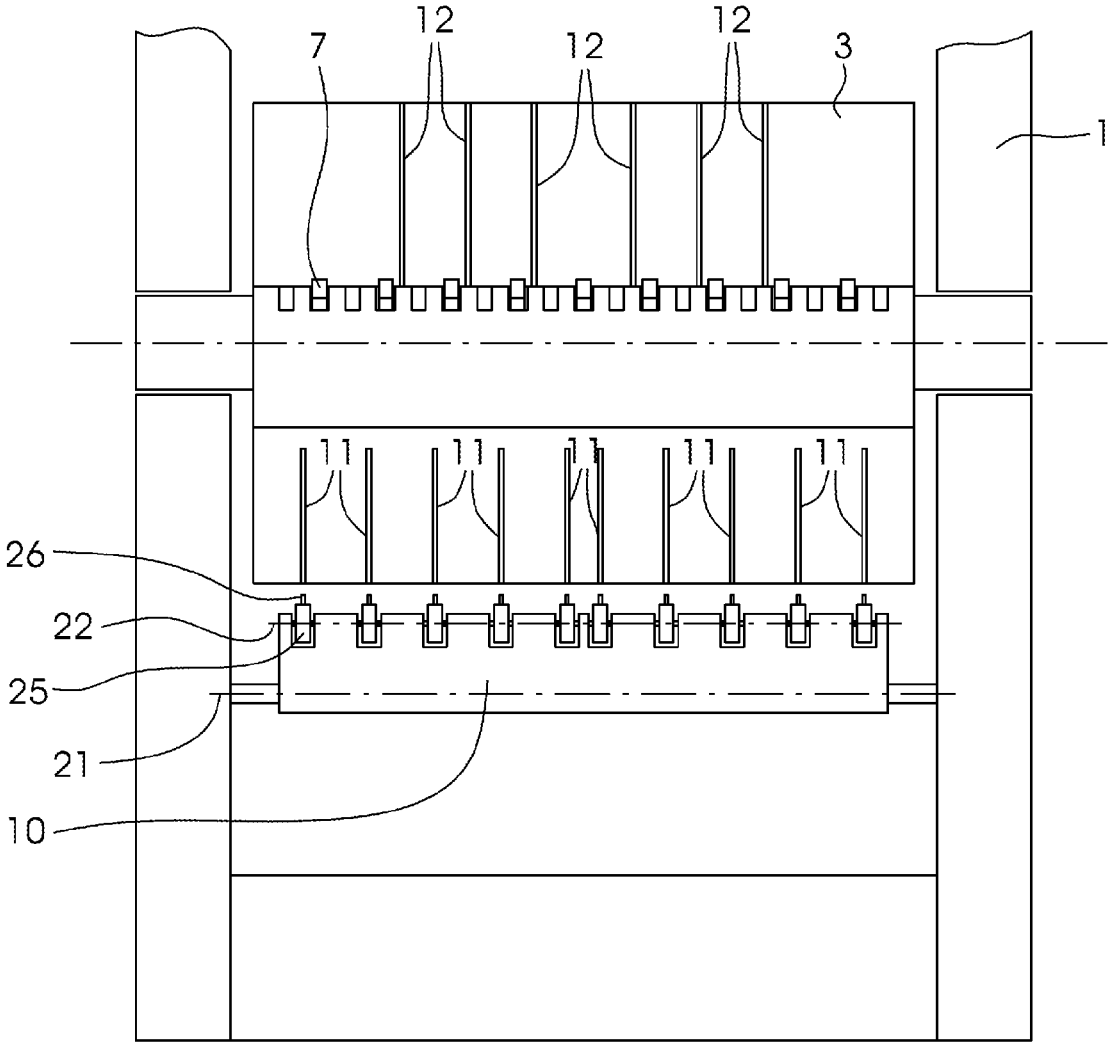
FIG. 2 is a fragmentary, side-elevational view of the vacuum drum and adjustment device of FIG. 1.

FIG. 2 is a different view of the vacuum drum 3, which is supported for rotation in side walls of a machine frame. For reasons of clarity, the transport cylinders 4, 5 are not illustrated in this figure. A slide adjustment device 10 for adjusting the closing slides 9 as a function of the format of the sheets B is provided below the vacuum drum. Together with the slide adjustment device, the vacuum drum 3 forms a vacuum drum system. The vacuum drum 3 and the slide adjustment device 10 together form a vacuum drum system. The vacuum drum 3 has first suction grooves 11 and second suction grooves 12 for attracting the sheets B by suction and for pneumatically holding the sheets B on the circumferential surface of the drum as the sheets B are being transported by the vacuum drum 3. The first and second suction grooves 11, 12 extend in the circumferential direction of the vacuum drum 3 and are connected to a vacuum source in accordance with the conveying cycle of the sheets B by a rotary valve so that a vacuum is applied to the suction grooves 11, 12.

Figure 3:
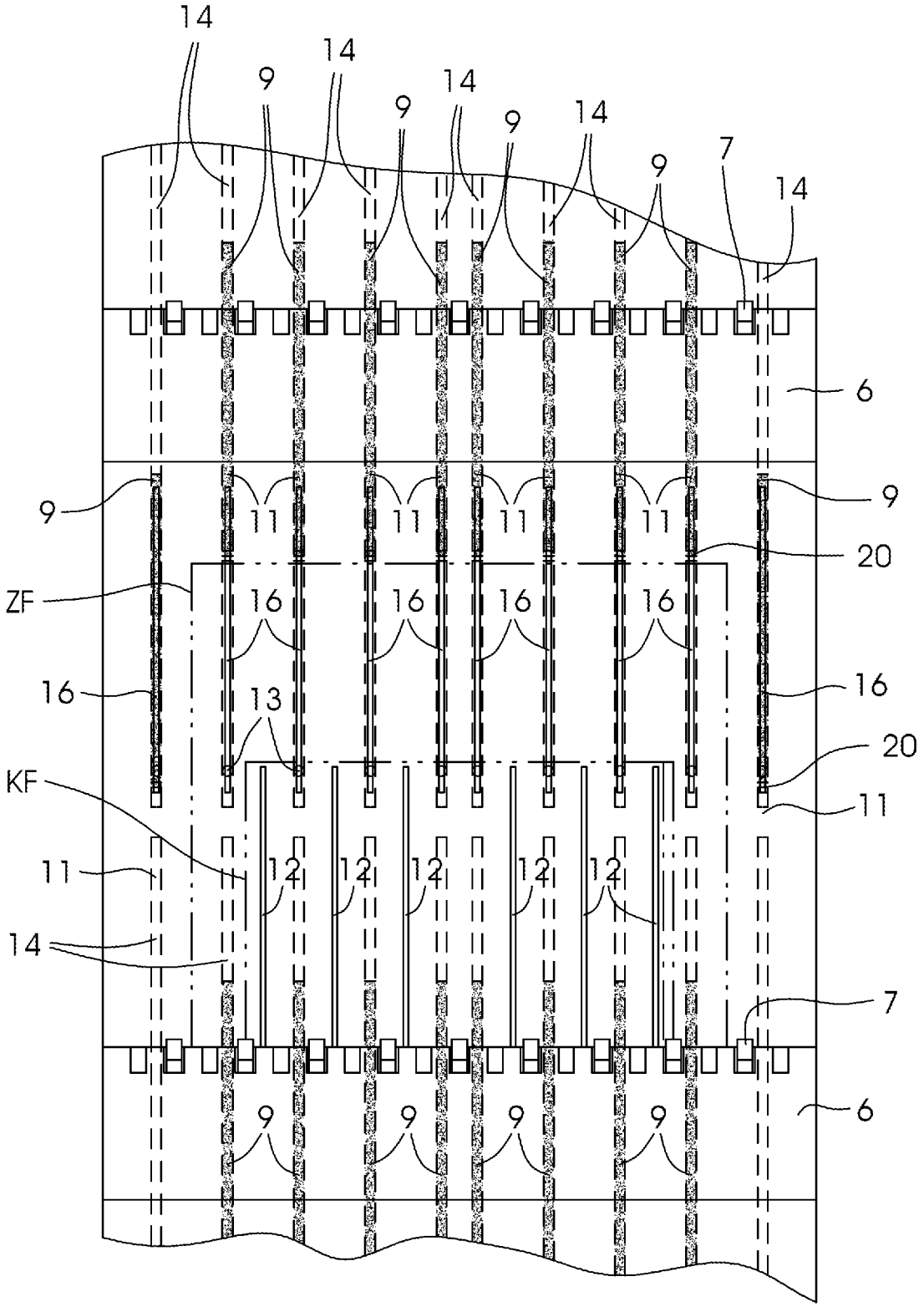
FIG. 3 is a fragmentary, unfolded view of the vacuum drum of FIG. 1.

FIG. 3 shows that the second suction grooves 12 and the clamping grippers 7 are disposed in an alternating manner and are not flush with each other. Likewise, the first suction grooves 11 are not flush with the clamping grippers 7. The first suction grooves 11 and the second suction grooves 12 are disposed in an alternating manner with the following exceptions: axially at the center of the drum, a pair of first suction grooves 11 is disposed between two second suction grooves 12. Multiple first suction grooves 11 or, in this case, more accurately two first suction grooves 11, are disposed between each respective axial drum end and the second suction groove 12 that is closest to the respective drum end. The first and second suction grooves 11, 12 are disposed so as to be mirror-symmetrical relative to the axial drum center.

A smallest format KF of the sheets B that may be transported by the vacuum drum 3 is illustrated in phantom lines. Whereas no largest format B is illustrated, an intermediate format ZF which is larger (longer and wider) than the smallest format KF but smaller than the largest format is shown. The second suction grooves 12 are completely covered by the smallest format KF, that is they do not extend beyond the smallest format KF. For the major part, the first suction grooves 11 extend outside the smallest format KF. There is only little overlap between those end regions of the first suction grooves 11 that lead as the vacuum drum 3 rotates during a printing operation and the trailing end regions of the second suction grooves 12. In the leading end regions of the first suction grooves 11, bores are formed in the bottoms of the first suction grooves 11 to form vacuum connections 13. These vacuum connections 13 and the suction air conduit system connected thereto connect the first suction grooves 11 to the aforementioned rotary valve. Receiving grooves 14 are formed in the circumferential surface of the drum on an opposite side of the gap so as to be aligned with the first suction grooves 11 formed on a first side of the cylinder gap 6. When end sections of the closing slides 9 protrude from the first suction grooves 11 in some positions of the closing slides 9, the receiving grooves 14 receive the end sections.

Figure 7:
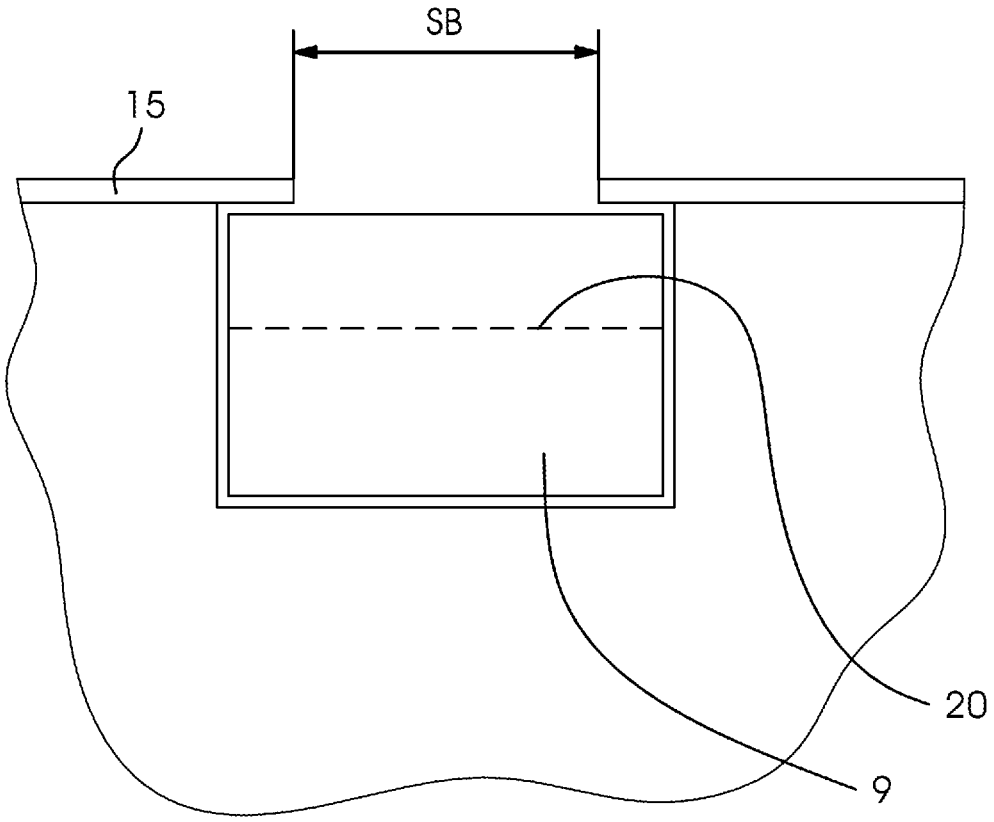
FIG. 7 is an enlarged sectional view of a closing slide in a suction groove of the vacuum drum of FIG. 1.

The closing slides 9 are inserted into the first suction grooves 11 and are displaceable along the latter in order for the position of the closing slides 9 to be continuously adjustable. The first suction grooves 11 extend around the axis of rotation of the vacuum drum 3 in the manner of a circular arc. The shape of the closing slides 9 is that of a circular ring section having a length which is in the shape of a circular arc yet with a different—e.g. smaller—radius of curvature than the first suction grooves 11. Consequently, the first suction grooves 11 and the closing slides 9 located therein are not concentric. Due to the differing radii of curvature, the closing slides 9 are under flexural stress when the closing slides 9 are inserted in the first suction grooves 11. A respective closing slide 9 wants to relieve the stress, causing the closing slide 9 to press against two opposing walls of the respective first suction groove 11. The closing slide 9 is clamped in the first suction groove 11 due to its preload. Thus, the closing slide 9 is frictionally held in its set position and does not require any additional retaining device such as a spring-loaded clamp. The two walls oppose each other in the radial direction of the vacuum drum 3 and are in the form of a bottom of the first suction groove 11 and a roof thereof formed by a cover 15. Suction slits 16 that are narrower than the first suction grooves 11 as seen in FIG. 7, are formed in the cover 15. Each suction slit 16 overlaps with a first suction groove 11 and extends at the center of the latter.

FIG. 3 shows the closing slides 9 in a position for processing the intermediate format ZF. The closing slides 9 that are located outside the format width of the intermediate format ZF have been moved far enough towards the beginning of the suction groove for the closing slides 9 to cover and close the vacuum connections 13. The remaining closing slides 9 located within the format width of the intermediate format ZF are withdrawn to such an extent that the front ends of these remaining closing slides 9 are located on a line with the trailing edge of the sheet in the intermediate format ZF or that the front ends protrude into the intermediate format ZF by only a few millimeters. The remaining closing slides 9 bridge the cylinder gap 6 in a cantilever manner with their end sections fitted into the receiving grooves 14. In a non-illustrated setting of the closing slides 9 for a sheet format that is smaller than the intermediate format ZF but larger than the smallest format KF, the remaining closing slides 9 would protrude from the first suction grooves 11 and extend into the cylinder gap 6 without extending into the receiving grooves 14. Instead of the cantilever bridge configuration, a provision might be made for the closing slides 9 in the region of the cylinder gap 6 to be guided in guides such as grooves provided on the inner side of the covering element or cover 8. The closing slides 9 of the first suction grooves located within the format width of the intermediate format ZF limit the active length of the first suction grooves 11. Each of the first suction grooves 11 that are located within the format width of the intermediate format ZF is only open on the circumferential side towards the environment in the longitudinal section covered by the sheet B and only applies suction in this longitudinal section. In the longitudinal section that is not covered by the sheet B, the first suction grooves 11 located within the format width of the intermediate format ZF are filled and closed by the closing slides 9 so as to be inactive in the non-covered longitudinal section without exerting any suction effect. The aforementioned settings of the closing slides 9 of the first suction grooves 11 located inside and outside the format width of the intermediate format ZF prevent any undesired attraction of air. The vacuum drum 3 is a double-size cylinder and has two support surfaces between the cylinder gaps 6 for the sheets B. Each of the support surfaces is provided with a set of first and second suction grooves 11, 12.

FIG. 4 shows the vacuum drum 3 with two covers 15 and two covers 8. Each cover 15 is provided with a set of suction slits 16. One cover 15 and one covering element or cover 8 may form a unit. Alternatively, two covers 8 which are separate from the covers 15 may be provided. In the so-called long version, the closing slides 9 are long enough for them in their position used for the smallest format KF to cover not only the vacuum connections 9 with the undersides of the slide but also the suction slits 16 along their entire slit lengths with their upper slide sides. This prevents the inert gas, such as nitrogen, in the inert gas chamber of the inert gas drying unit from getting into the first suction grooves 11 through the suction slits 16 and from thus being transported therein out of the inert gas chamber due to the rotation of the drum. The covers 8, which have minimized holes for the fingers of the clamping grippers 7 to pass through and minimized openings for the clamping grippers of the adjacent transport cylinders 4, 5 to dip into, act to seal the cylinder gaps 6 in a quasi-hermetic way and to prevent inert gas from escaping from the inert gas chamber. FIG. 4 illustrates various stages of an adjustment process of the closing slide 9. The closing slide 9 shown on the right-hand side has already been moved into the correct operating position for the format of the sheets to be processed, i.e. the leading edge of the closing slide 9 is located approximately at the same point on the circumference of the drum as the trailing edge of the sheet B. The closing slide 9 shown on the left-hand side is being moved to the correct operating position by being held by the slide adjustment device 10 and simultaneously rotating the base body of the vacuum drum 3 in the direction indicated by the arrow. Thus, the relative movement between the closing slide 9 and the base body of the vacuum drum 3 to adjust the closing slide 9 is not attained by actively moving the closing slide 9 but by actively moving the base body. On its outer side, each closing slide 9 has a cross groove 20 for the slide adjustment device 10 to engage in, in order to retain the respective closing slide 9. The slide adjustment device 10 passes through the suction slit 16 in the cover 15. In a non-automated alternative, the operator might introduce a tool such as a screw driver into the cross groove 20 to displace the closing slide 9 manually. A bore or other type of fit-in profile may be provided instead of the cross groove 20. The sheet B on the vacuum drum 9 is only shown to clarify the correct operating position of the closing slide 9. When the vacuum drum 3 is being set up, there will actually not be any sheet B located thereon.

Figure 5:
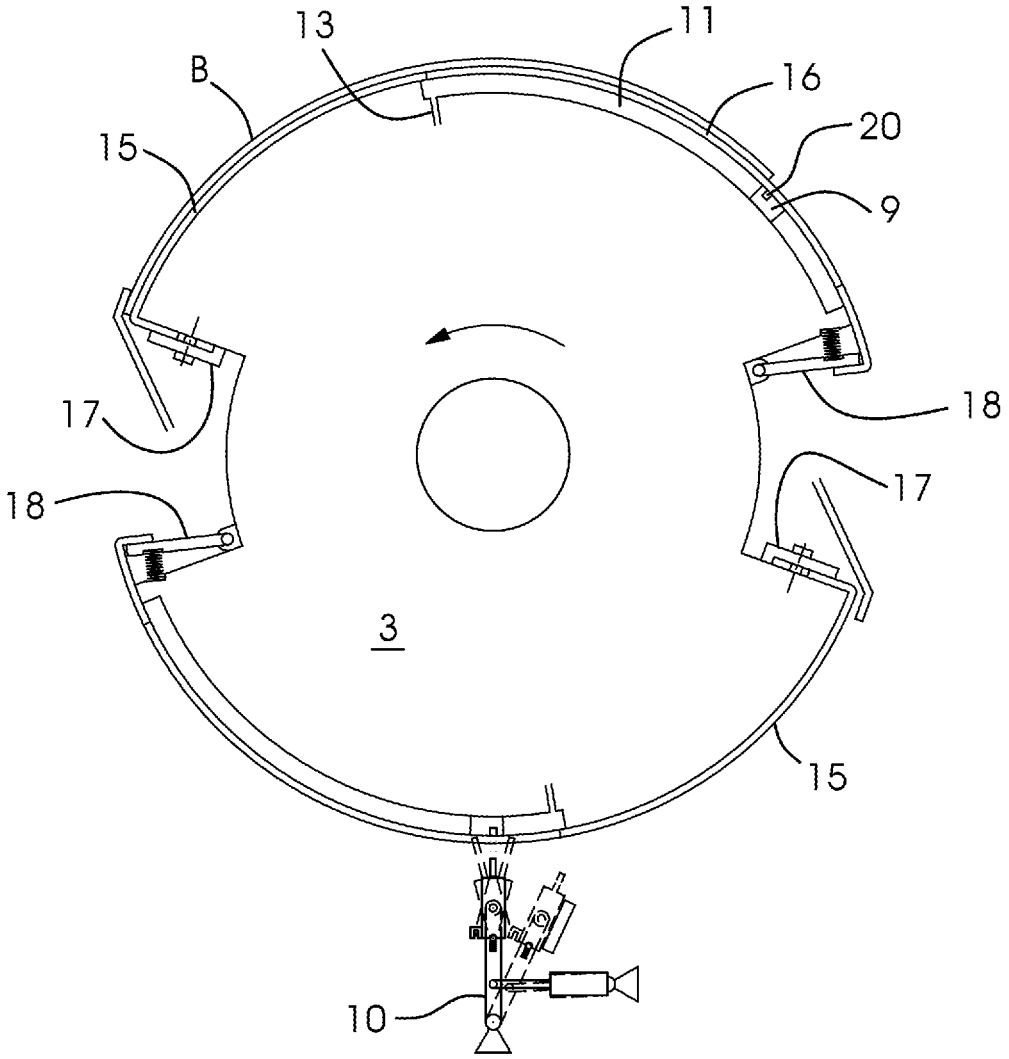
FIG. 5 is a cross-sectional view of a second variant of the vacuum drum of FIG. 1.

FIG. 5 illustrates a modified version of the vacuum drum 3 shown in FIGS. 1 to 4. The modified version is suited for use in in-line measuring units and ink jet printing units. These types of special-purpose units 2 do not use any inert gas and therefore there is no need to prevent inert gas from entering the vacuum drum 3. Thus, the covers 8 may be dispensed with and the closing slides 9 may be short. The respective closing slide 9 separates the section within the respective sheet format of the respective first suction groove 11 from the section outside the respective sheet format of the first suction groove 11 without filling the latter section across its entire length. The section of the suction slit 16 that is not covered by the sheet B is not fully covered by the closing slide 9 in the short version. The covers 15 are held on the vacuum drum 3 by mounting devices. Each mounting device includes a clamping device 17 for holding the leading edge of the cover 15 and a tensioning device 18 for holding the trailing edge and for tensioning the cover 15 in the circumferential direction. The clamping devices 17 and tensioning devices 18 are disposed in the cylinder gaps 6. The respective clamping device 17 includes a clamping jaw and a screw for actuating the clamping jaw. The angled leading rim of the cover 15 is clamped between the clamping jaw and a wall of the cylinder gap 6. The respective tensioning device 18 includes a lever and a spring for urging the lever away from a wall of the other cylinder gap 6. The angled trailing rim of the cover 15 is hooked into the lever. Such clamping devices 17 and tensioning devices 18 may also be provided for the vacuum drum of the exemplary embodiment shown in FIG. 4. In this case, recesses for the closing slides 9 in the long version to be moved through would have to be provided in the levers of the tensioning devices 18, in the angled rims of the covers 15 and, if necessary, in the clamping jaws of the clamping devices 17.

The functioning of the slide adjustment device 10 is shown in FIGS. 6A-6D on the basis of the vacuum drum 3 with closing slides 9 in the short version seen in FIG. 5. This description is also valid for the vacuum drum 3 that has closing slides 9 in the long version seen in FIG. 4. The slide adjustment device 10 includes a longitudinal crossbar 19 extending parallel to the axis of the vacuum drum, i.e. perpendicular to the plane of the image of FIG. 6A. The crossbar 19 has approximately the same length as the vacuum drum 3 and is pivotable back and forth between an inactive position, which it assumes during a printing operation (shown in FIG. 6A), and an operating position (shown in FIG. 6B) for making format adjustments. The crossbar 19 is pivoted about a first joint 21 by an actuating drive 23 such as a pneumatic operating cylinder. In the operating position, the crossbar 19 is radially aligned relative to the vacuum drum 3. A row of pneumatic operating cylinders 25 is provided along the crossbar 19. Instead of the operating cylinders 25, other actuating drives that generate a linear movement may be provided, for instance electromagnetic actuating drives. Each operating cylinder 25 is connected to the crossbar 19 by a second joint 22. Each operating cylinder 25 is aligned with another closing slide. The number of operating cylinders 25 corresponds to the number of first suction grooves 11 of only one sheet supporting surface and thus to the number of closing slides 9 of only one sheet supporting surface. This means, for instance, that the double-size vacuum drum 3 shown in FIGS. 1 to 5 has two cylinder gaps 6 and two sheet supporting surfaces located therebetween and each sheet supporting surface has ten first suction grooves 11. Thus, the total number of first suction grooves 11 is twenty, as is the total number of associated closing slides. In this case, the row of operating cylinders 25 includes only ten operating cylinders 25 because each operating cylinder 25 has the dual function of adjusting a closing slide 9 of the one sheet supporting surface and a closing slide 9 of the other sheet supporting surface. A piston rod 26 of the respective operating cylinder 25 is movable into an operating position seen in FIG. 6*c* for engagement with the cross groove 20 of the closing slide 9 to be adjusted and back into a rest position seen in FIG. 6B disengaged from the cross groove 20.

Figure 6A:
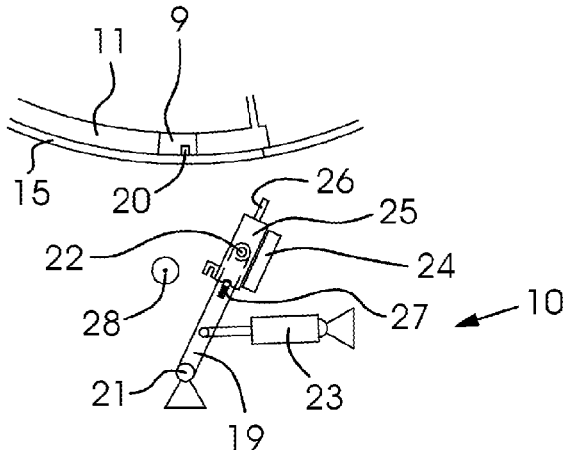
FIGS. 6A-6D are fragmentary, cross-sectional views illustrating different positions of the slide adjustment device of FIGS. 1.
Figure 6B:
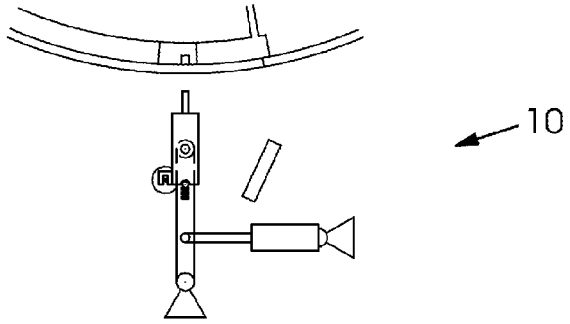
Figure 6C:
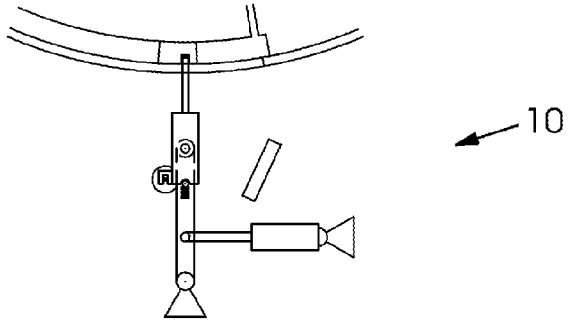
Figure 6D:
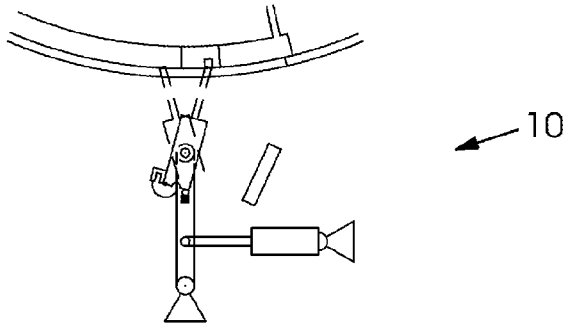

Each operating cylinder 25 is assigned a ratchet 27 for locking the operating cylinder 25 in a position in which it is aligned with the crossbar 19 as seen in FIG. 6C. In this aligned position, the operating cylinder 25 is radially aligned relative to the vacuum drum 3 when the crossbar 19 is in its operating position. Each ratchet 27 includes a respective spring-loaded pressure piece such as a ball that snaps into a groove in the operating cylinder 25. The ratchets 27 act as overload protectors that protect the slide adjustment device 10 from damage due to excessive external forces. Such a force might occur if contamination causes a closing slide 9 to be harder to move in the first suction groove 11 than intended. Without overload protection, the closing slide 9 in question would exert an excessive force on the piston rod that is engaged with the respective closing slide 9 when the vacuum drum 3 rotates during a format adjustment. The overload protection causes the ratchet 27 to be released when a predefined force threshold or a predefined threshold torque is exceeded. The pressure piece is urged out of the groove and the external force causes the operating cylinder 25 to pivot about the second joint 22 in a direction that depends on the direction of rotation of the vacuum drum 3 and thus on the direction of action of the force, to rotate into an error position. The two error positions of the operating cylinder are shown in FIG. 6D as the tilted positions of the operating cylinder indicated by the two phantom lines. The aforementioned force threshold is determined by the spring force of the ratchet spring and by the geometry of the engagement elements (pressure piece, groove) of the ratchet 27, for instance by the diameter of the ball.

A monitoring device 28 informs an electronic control unit when one or more operating cylinders 25 are in an error position. Advantageously, only one sensor is necessary to monitor all operating cylinders 25 because the monitoring device 28 is embodied as a common monitoring device 28 for monitoring all operating cylinders 25. The monitoring device 28 operates in accordance with a touch-free, optical principle of operation and is embodied as a one-way photoelectric sensor. Each operating cylinder 25 is provided with a radiation interrupting element (referred to as a "flag") in the shape of a fork that is open in a downward direction or in the shape of an inverted "U". The emitter (light source) and the receiver (sensor) of the monitoring device 28 are directed towards one another and are spaced apart from one another on a line that is parallel to the row of flags and thus perpendicular to the plane of the image of FIGS. 6A to 6D. The flags of all operating cylinders 25 are located between the emitter and the receiver. When the crossbar 19 is in the operating position and the operating cylinders 25 are in their correct positions seen in FIG. 6C, the flags are aligned in such a way that the light beam of the receiver passes through the recesses or slits in the flags unimpeded. That is to say that the light beam passes unimpeded between the two arms of the fork or the two legs of each flag. The respective flag will temporarily interrupt the light beam when the corresponding operating cylinder 25 is deflected relative to the crossbar 19 due to an overload. If the operating cylinder 25 is deflected in a clockwise direction, one fork arm of the flag will interrupt the light beam. If the operating cylinder 25 is deflected in a counter-clockwise direction, the other fork arm will interrupt the light beam. The monitoring device 28 is advantageously effective in both deflecting or pivoting directions. The impulse-like interruption is detected by the receiver, which will then inform the control unit of the fact that at least one operating cylinder 25 is in an error position. The signal automatically triggers an action of the control unit. The action may be to display the error position. The action may be an automated correction of the error position. Irrespective of whether the correction is made with or without an operator's intervention, the following events will occur: the actuating drive 23 pivots the crossbar 19 from the operating position back into the rest position seen in FIG. 6A, causing the operating cylinders 25 to hit a stop 24. The stop 24 is a crossbar extending parallel to the crossbar 19 along the length thereof. Instead of this common stop 24 of the operating cylinders 25, a row of individual stops may be provided. By hitting the stop 24, each operating cylinder 25 that is in a deflected error position is urged back into its correct pivoting position in which the ratchet 27 is locked. The stop 24 is disposed in such a way that both a respective operating cylinder 25 in an error position due to a deflection in a clockwise direction and a respective operating cylinder 25 in an error position due to a deflection in a counterclockwise direction will be pivoted back into its correct position by hitting the stop 24. The respective operating cylinder 25 that is in an error position due to a deflection in a clockwise direction will hit the stop 24 first with its upper operating cylinder section located on one side of the second joint 22. The respective operating cylinder 25 that is in an error position due to a deflection in the counter-clockwise direction will hit the stop 24 first with its lower operating cylinder section located on the other side of the second joint 22.

FIG. 7 is a cross-sectional view of an example of the first suction grooves 11. The profile of the first suction groove 11 has a quadrangular inner contour. The profile of the closing slide 9 located in the first suction groove 11 has a quadrangular outer contour. The two profiles match each other in the sense that on one hand, the closing slide 9 is locked by a self-clamping effect as described above and on the other hand, it is possible for the closing slide 9 to slide. The amount of play between the lateral inner surfaces of the first suction groove 11 and the lateral outer surfaces of the closing slide 9 is small enough to prevent excessive amounts of air from passing between these surfaces in an undesired way. It can be seen that a slit width SB of the suction slit 16 in the cover 15 covering the first suction groove 11 is smaller than the width of the first suction groove 11. Thus, the suction slit 16 and the first suction groove 11 together form a kind of a T groove. The slit width SB is greater than the diameter of the piston rods 26 of the operating cylinders 25 and is thus selected in such a way that when the adjustment device 10 is in engagement with the cross groove 20, the adjustment device 10 may pass through the suction slit 16. The cover 15 secures the closing slide 9 against falling out of the first suction groove 11. With its upper side facing the cover 15, the closing slide 9 rests against the underside of the cover 15, which protrudes into the first suction groove 11 from both sides. The first cover 15 is torsionally flexible and is formed of a metal or plastic foil. Different covers 15 with different slit widths SB may be provided for the vacuum drum 3. Depending on the respective print job, the operator may equip the vacuum drum 3 with covers 15 having a slit width B which is best suited for the print job. For instance, the operator may exchange the covers 15 to vary the slit width SB as a function of the thickness and weight of the sheets B. In order to process sheets B of thin paper, the operator may mount covers of a different slit width SB to the vacuum drum 3 than would be used to process sheets B of thick cardboard.

The invention claimed is:

1. A vacuum drum system for a printing material sheet processing machine, the vacuum drum system comprising:

a vacuum drum having suction grooves formed therein for pneumatically holding the printing material sheet; and closing slides disposed in said suction grooves, said closing slides being curved.

2. The vacuum drum system according to claim 1, wherein said closing slides are displaceable into various positions, and said suction grooves have an active suction length being variable to accommodate varying formats of sheets of printing material.

3. The vacuum drum system according to claim 1, wherein said closing slides have a radius of curvature, said suction grooves have a radius of curvature, said radius of curvature of said closing slides is different from said radius of curvature of said suction grooves, and said closing slides lock in position by a self-clamping effect.

4. A vacuum drum system for a printing material sheet processing machine, the vacuum drum system comprising:

a vacuum drum having suction grooves formed therein for pneumatically holding the printing material sheet said vacuum drum having a cylinder gap and receiving grooves formed therein; and closing slides disposed in said suction grooves, said closing slides being adjustable into a position bridging said cylinder gap and being fitted in said receiving grooves.

5. The vacuum drum system according to claim 1, which further comprises a slide adjustment device being separate from said vacuum drum and configured to retain said closing slides as said vacuum drum rotates, and said retained closing slides being displaceable along said suction grooves.

6. The vacuum drum system according to claim 5, wherein said closing slides have cross grooves formed therein forming plug profiles, said slide adjustment device includes a series of actuating drives configured to be coupled to said closing slides by said plug profiles, and said actuating drives are operating cylinders.

7. The vacuum drum system according to claim 6, wherein said slide adjustment device includes overload protectors for protecting said actuating drives against overload, and said overload protectors are ratchets.

8. The vacuum drum system according to claim 6, wherein said slide adjustment device includes a monitoring device for detecting error positions of said actuating drives, and said monitoring device is a photoelectric sensor.

9. The vacuum drum system according to claim 1, which further comprises a cover covering said suction grooves, said cover having suction slits formed therein covering said suction grooves, and said suction slits having widths being smaller than widths of said suction grooves.

10. A drying unit for drying printing material sheets using UV or electron irradiation in an inert gas atmosphere, the drying unit comprising:

a vacuum drum system according to claim 1.

11. A vacuum drum system for a printing material sheet processing machine, the vacuum drum system comprising:

a vacuum drum having suction grooves formed therein for pneumatically holding the printing material sheet, said suction grooves extending in a circumferential direction of said vacuum drum; and closing slides disposed in said suction grooves.

* * * * *